US007232351B2

(12) United States Patent
Nakajima

(10) Patent No.: US 7,232,351 B2
(45) Date of Patent: Jun. 19, 2007

(54) PERSONAL WATERCRAFT

(75) Inventor: Jun Nakajima, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/282,036

(22) Filed: Oct. 29, 2002

(65) Prior Publication Data

US 2003/0129887 A1 Jul. 10, 2003

(30) Foreign Application Priority Data

Oct. 30, 2001 (JP) ..... 2001-333262

(51) Int. Cl.
*B63B 35/73* (2006.01)
*B63H 21/36* (2006.01)
*B63H 21/38* (2006.01)
*F02M 35/104* (2006.01)

(52) U.S. Cl. ..... 440/88 A; 114/55.53; 114/55.57

(58) Field of Classification Search ..... 440/88 R, 440/88 A; 114/55.5, 55.55, 55.57, 55.53; 123/184.24, 184.34, 184.42, 184.47, 184.48, 123/184.57
See application file for complete search history.

(56) References Cited

U.S. PATENT DOCUMENTS 5,743,206 A * 4/1998 Hattori ..... 114/55.51
5,778,833 A * 7/1998 Kuranishi ..... 123/52.4
5,902,161 A * 5/1999 Nakase ..... 440/88 R
6,016,782 A * 1/2000 Henmi ..... 123/184.46
6,112,685 A * 9/2000 Matsuda et al. ..... 114/55.53
6,263,851 B1 * 7/2001 Henmi ..... 123/184.46
6,302,752 B1 * 10/2001 Ito et al. ..... 440/88 R
6,312,299 B1 * 11/2001 Henmi ..... 440/88 R
6,478,002 B1 * 11/2002 Mashiko ..... 123/184.42
6,532,914 B2 * 3/2003 Washizu ..... 123/41.41

(Continued)

FOREIGN PATENT DOCUMENTS

JP 09301271 A * 11/1997

(Continued)

OTHER PUBLICATIONS

Machine Translation of JP 2000-238693 A.*

(Continued)

*Primary Examiner*—Ajay Vasudeva
(74) *Attorney, Agent, or Firm*—Birch, Stewart, Kolasch & Birch, LLP

(57) ABSTRACT

A personal watercraft includes a saddle ride type seat provided at a roughly central portion of a watercraft body, an engine mounted on the lower side of the seat and directed in a front-rear direction of the watercraft body, and cylinders provided in the engine are arranged in the front-rear direction of the watercraft body. First to fourth intake pipes communicated with the cylinders are extended from a side surface of the engine, and an air box containing the intake pipes is provided in a space between the engine and a left side wall. The air box includes a box main body and a cover body, and the cover body is disposed facing toward the left side wall. The left side wall facing toward the cover body is provided with an opening, and a side cover is provided to be capable of being fitted to and detached from the opening. Maintenance or inspection of intake system equipment can be easily carried out with the aforementioned personal watercraft.

15 Claims, 12 Drawing Sheets

U.S. PATENT DOCUMENTS

| | | | | |
|---|---|---|---|---|
| 6,578,508 | B2 * | 6/2003 | Hattori et al. | 114/55.57 |
| 6,672,918 | B2 * | 1/2004 | Mashiko et al. | 440/88 R |
| 2003/0036320 | A1 * | 2/2003 | Matsuda | 440/88 |

FOREIGN PATENT DOCUMENTS

| | | | |
|---|---|---|---|
| JP | 10205346 | A * | 8/1998 |
| JP | 2000238693 | A * | 9/2000 |
| JP | 2001193585 | A * | 7/2001 |

OTHER PUBLICATIONS

English language translation of Abstract of Japanese Patent Publication No. 08048287A dated Feb. 20, 1996, for "Compact Planing Boat".

* cited by examiner

PERSONAL WATERCRAFT

BACKGROUND OF THE INVENTION

CROSS-REFERENCES TO RELATED APPLICATIONS

This nonprovisional application claims priority under 35 U.S.C. § 119(a) on patent application No. 2001-333262 filed in Japan on Oct. 30, 2001, the entirety of which is herein incorporated by reference.

1. Field of the Invention

The present invention relates to a personal watercraft; and more particularly to a personal watercraft having a saddle ride type seat provided at a roughly central portion of a watercraft body, an engine mounted on a lower side of the seat in a condition directed toward a front-rear direction of the watercraft body, and intake pipes communicating respectively with a plurality of cylinders provided in the engine and extending from a side surface of the engine.

2. Description of the Background Art

Personal watercraft have been known in the background art, for example as in Japanese Patent Laid-open No. Hei 8-48287, the entirety of which is hereby incorporated by reference. FIG. 1 of 8-48287 has been repeated in some of the figures of the present application (symbols are reassigned). This type of personal watercraft will be described in detail hereinafter.

FIG. 13 is a sectional view of a conventional personal watercraft. The personal watercraft 100 has a structure in which left and right side walls 102 and 103 are provided at roughly central portions of a deck 101, a saddle ride type seat 104 is provided at upper ends of the left and right side walls 102 and 103, an engine 105 is provided on the lower side of the seat 104 and directed in the front-rear direction of a watercraft body 106. Cylinders 105*a* are inclined to the right side of the watercraft 100 to open a space 107 on the left side of the engine 105, and an intake system equipment 108 is provided in the left-side space 107. The intake system equipment 108 is prevented from projecting to the left side from the center 106*a* of the watercraft body 106.

Since the intake system equipment 108 is prevented from excessively projecting to the left side from the center 106*a* of the watercraft body 106, the spacing between the left and right side walls 102 and 103 of the deck 101 can be reduced. Therefore, when a driver sits astride the saddle ride type seat 104 and puts their feet on foot rests 101*a*, 101*a* of the deck 101, the driver can maintain a natural posture.

The intake system equipment 108 has a structure in which an intake silencer (air box) 108*b* is communicated to the cylinders 105*a* through air funnels 108*a*, and an intake pipe 108*c* is in communication with the intake silencer 108*b*. Air taken into the intake pipe 108*c* through an intake port 108*d* of the intake pipe 108*c* is led into the air box 108*b* through the intake system equipment 108. The air led into the air box 108*b* is introduced into the cylinders 105*a* through the air funnels 108*a*.

At the time of performing maintenance or inspection of the intake system equipment in the personal watercraft, the seat 104 is usually detached from a seat base of the watercraft body 106. A maintenance opening 109 provided in a ceiling plate of the seat base is then opened. Maintenance or inspection of the intake system equipment or the like is carried out by utilizing the maintenance opening 109.

The present inventors have determined that the background art suffers from the following disadvantages. Since the maintenance opening 109 is provided in the ceiling plate of the seat base, the maintenance opening 109 is directed upwards. Therefore, in order to perform maintenance or inspection of the intake system equipment, particularly, the inside of the air box 108*b* by utilizing the maintenance opening 109, the maintenance of the air box 108*b* must be carried out through the opening 108*e* on the upper side.

However, in order to keep the spacing between the left and right side walls 102 and 103 of the deck 101 in the personal watercraft 100 small, it is necessary to keep the width W of the air box 108*b* small. It is difficult for maintenance personnel to insert their hands in from the upper side in the aforementioned systems of the background art, and it is therefore difficult to carry out maintenance or inspection of the inside of the air box 108*b*.

SUMMARY OF THE INVENTION

The present invention overcomes the shortcomings associated with the background art and achieves other advantages not realized by the background art.

An object of the present invention is to provide a personal watercraft in which maintenance or inspection of intake system equipment is easily carried out.

One or more of these and other objects are accomplished by a personal watercraft comprising a watercraft body having a central portion, a forward portion and a rearward portion; a saddle-ridden seat being generally provided at the central portion of the watercraft body; a pair of covers forming side walls extending downwards from left and right lower edges of the seat, an engine mounted on the lower side of the seat with the axis of a crankshaft thereof directed in a front-rear direction of the watercraft body with respect to the forward portion and the rearward portion; a plurality of cylinders being provided in the engine and arranged in the front-rear direction of the watercraft body; intake passages being communicated respectively with the cylinders and extending from a side surface of the engine; and an air box containing the intake pipes being provided in a space between the engine and the side walls, wherein the air box includes a box main body, a cover body, the cover body being disposed in a position facing toward the side wall, an opening provided with the cover body, the side walls facing the cover body, and a cover capable of being detachable fitted to the opening.

In order to ensure that the driver can easily sit astride the saddle ride type seat, the width of the air box must be narrow. However, the side surface of the air box can be made comparatively large. In view of this, the cover body of the air box faces to the sidewall on the lower side of the seat, and the side wall facing to the cover body is provided with the opening. The cover is provided capable of being fitted to and detached from the opening. By detaching the cover from the side wall to open the opening, it is possible to easily detach the cover body from the box main body by utilizing the opening. Since the cover body is disposed at a side surface of the air box, the cover body can be made relatively large in size.

With the fitting surface of the box main body for fitting the cover body formed substantially parallel to the side wall, bolts and the like at the fitting surface can be made easily accessible from the front of the opening. Therefore, it is easy to insert a fastening tool to head portions of the bolts from the outside of the opening, so that the cover body can be easily detached without special labor or tools. In addition, maintenance or inspection of the inside of the air box can be easily carried out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
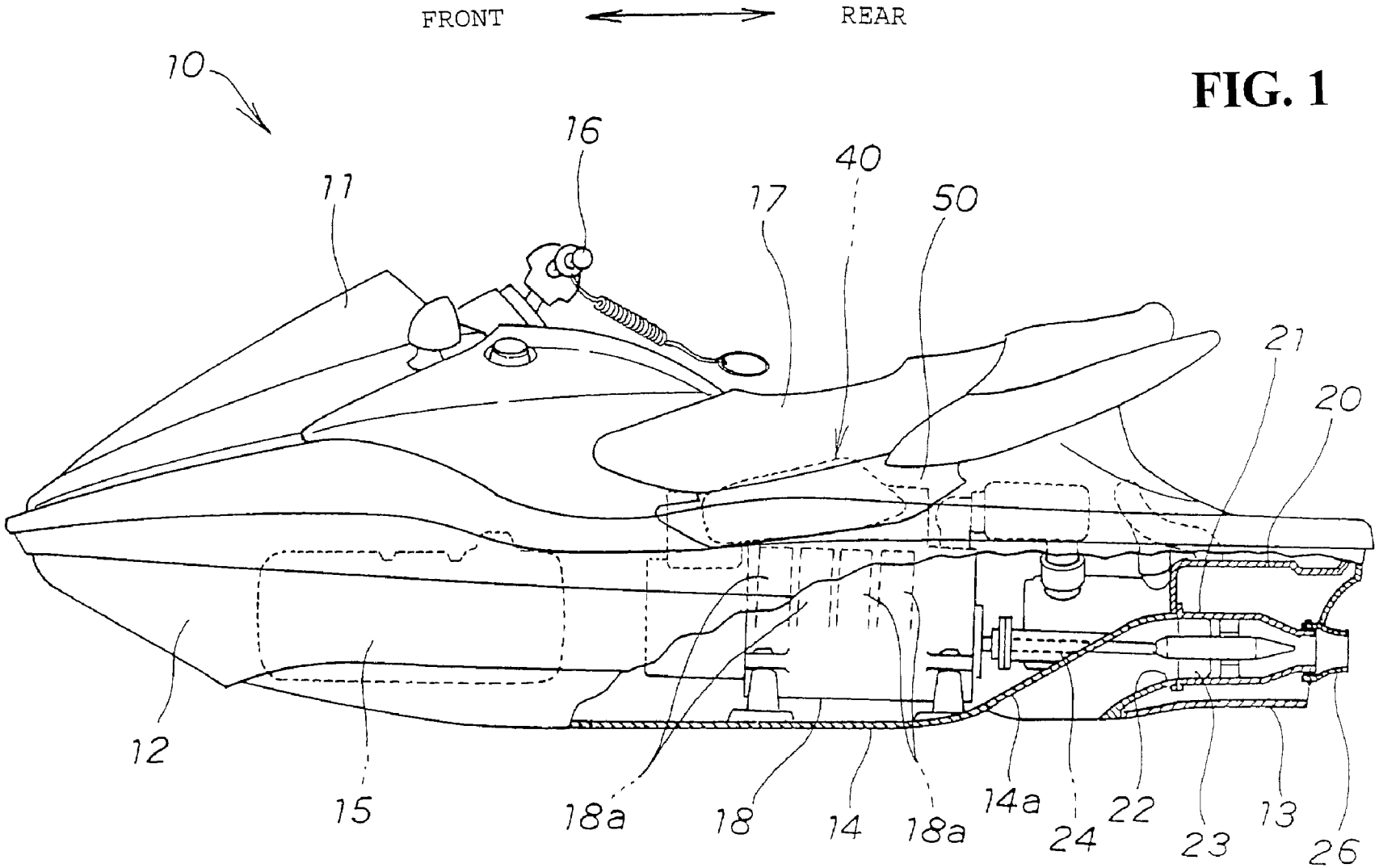
FIG. 1 is a side view of a personal watercraft according to the present invention.

The present invention will hereinafter be described with reference to the accompanying drawings. An embodiment of the present invention will be described hereinafter with reference to the accompanying drawings. FIG. 1 is a side view of a personal watercraft according to the present invention. The personal watercraft 10 is a jet propulsion watercraft in which a fuel tank 15 is fitted to a front portion 12 of a watercraft body 11, a steering handle 16 is provided on the upper side of the fuel tank 15, a saddle ride type seat 17 is provided on the rear side of the steering handle 16, and an engine 18 is provided on the lower side of the seat 17. A jet propeller chamber 20 is provided at a stern 13 on the rear side of the engine 18, and a jet propeller 21 is provided in the jet propeller chamber 20.

The jet propeller 21 includes a housing 22 extending rearwards from an inlet 14*a* formed in a watercraft bottom 14, an impeller 23 is rotatably fitted in the housing 22, and the impeller 23 is connected to a drive shaft 24 of the engine 18. With the impeller 23 rotated by the engine 18, water is drawn in through the inlet 14*a* formed in the watercraft bottom 14, and the water thus sucked in is led through the housing 22 to a steering nozzle 26 as jet water. The jet water led to the steering nozzle 26 is jetted from the steering nozzle 26, whereby the personal watercraft 10 can be propelled.

Figure 2:
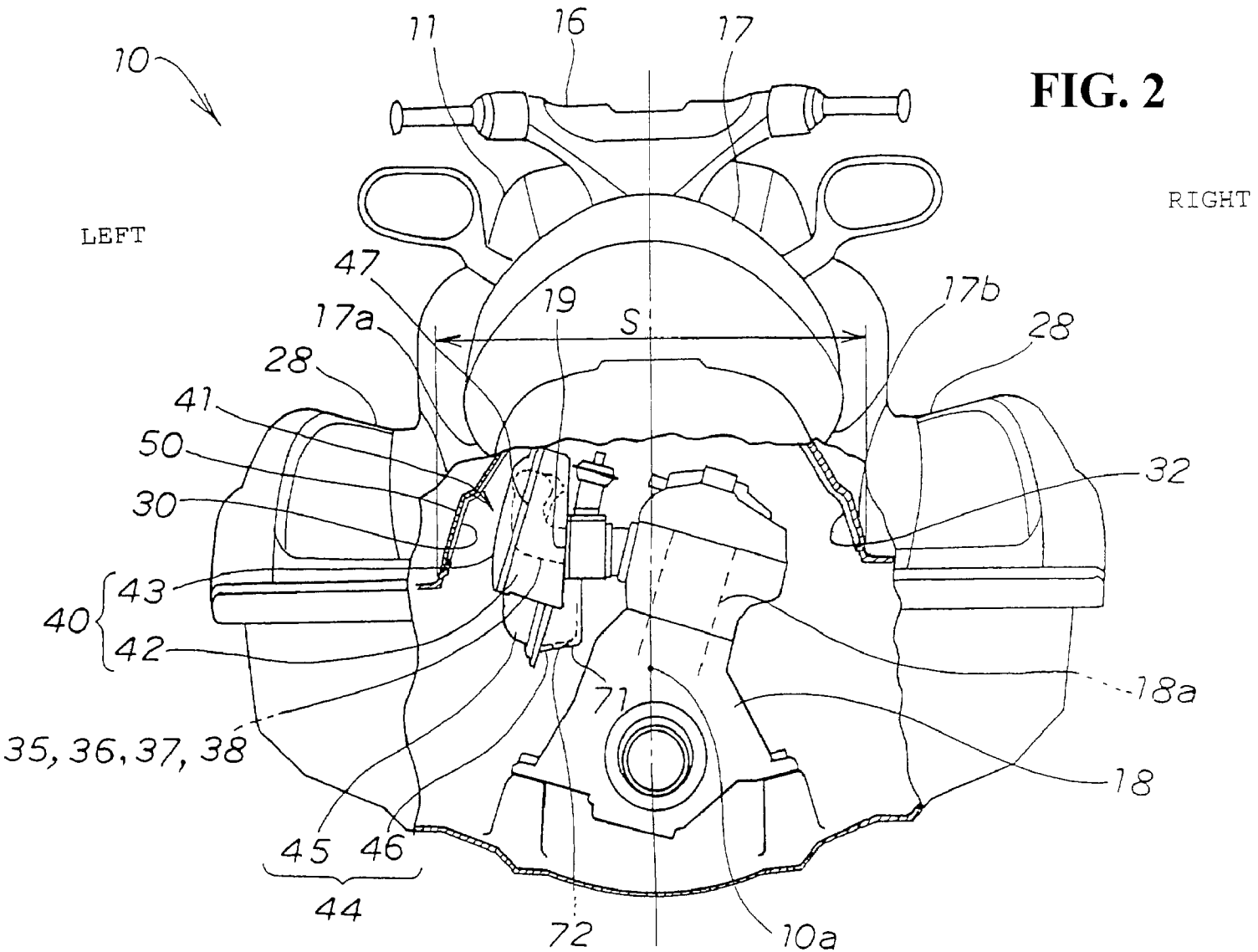
FIG. 2 is a rear elevation of a portion of the personal watercraft according to the present invention.

FIG. 2 is a rear elevation of a portion of the personal watercraft according to the present invention. The personal watercraft 10 has a structure in which the saddle ride type seat 17 is provided at a roughly central portion of the watercraft body 11, covers forming left and right side walls 30 and 32 are extended downwards from left and right lower edges 17*a* and 17*b* of the seat 17. The engine 18 is mounted on the lower side of the seat 17 with the axis of a crankshaft thereof directed in the front-rear direction of the watercraft body 11 (See also FIG. 1). The engine 18 includes a plurality of cylinders 18*a* (See also FIG. 1) provided in the engine 18 and arranged in the front-rear direction of the watercraft body 11, and intake pipes (namely, air funnels) 35, 36, 37, 38 communicated respectively with the cylinders 18*a* and extended from a side surface 19 of the engine 18. An air box 40 containing the intake pipes 35 to 38 is provided in a space 41 between the engine 18 and the left side wall (side wall) 30.

With the engine 18 inclined to the right side with respect to the watercraft body 11, the space 41 between the engine 18 and the left side wall 30 can be made relatively large. With the intake pipes 35 to 38 and the air box 40 provided in the space 41, the intake pipes 35 to 38 and the air box 40 can be prevented from excessively projecting to the left side with respect to the center 10*a* of the watercraft body 11.

Therefore, the spacing S between the left and right side walls 30 and 32 can be made relatively small. Accordingly, when the driver sits astride the saddle ride type seat 17 and puts his feet on foot rests 28, 28 of the deck, the driver can maintain a natural driving posture. In addition, the air box 40 includes a box main body 42 fitted to the engine 18, a cover body 43 detachably fitted to the box main body 42, and a bulged portion 44 provided at a front portion of the box main body 42. The air box 40 has the cover body 43 disposed facing toward the left side wall 30 of the watercraft body 11.

The bulged portion 44 includes a support frame 45 formed integrally with the front portion of the box main body, and a bulged or expanded cover 46 detachably fitted to the support frame 45. In addition, a fitting surface 47 of the box main body 42 for fitting the cover body 43 is substantially parallel to the left side wall 30.

Figure 3:
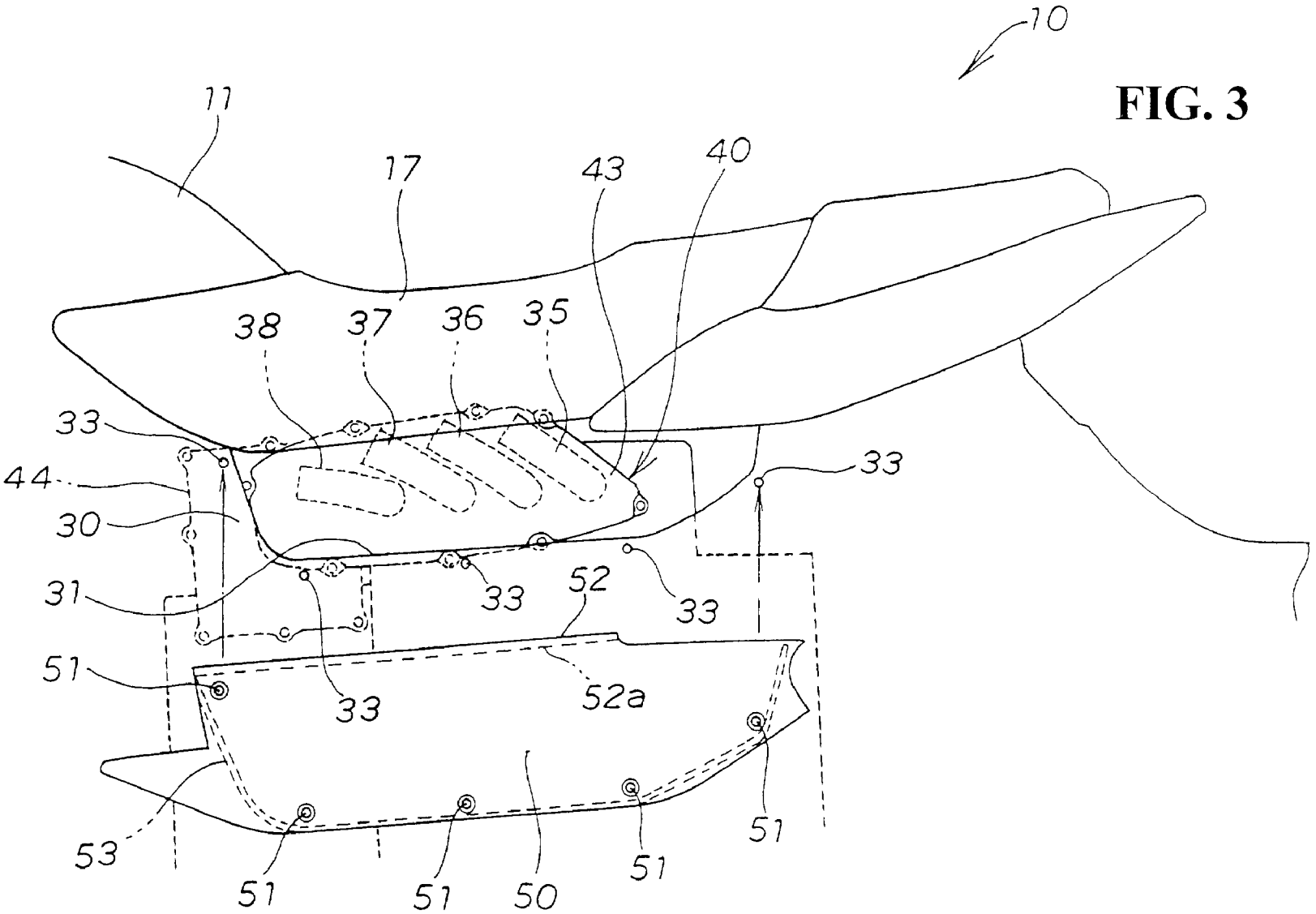
FIG. 3 is a side view of a portion of the personal watercraft according to the present invention.

FIG. 3 is a side view of a portion of the personal watercraft according to the present invention, and shows a condition where a left side wall, e.g, a side wall on a lower side of the seat 30 facing to the cover body 43 is provided with an opening 31, and a side cover (cover) 50 is provided to be capable of being fitted to and detached from the opening 31.

Bolts (not shown) are inserted into insertion holes 51 provided at a peripheral edge of the side cover 50, and bolts inserted into the insertion holes 51 are screw-connected to fitting holes 33 of the left side wall 30. The side cover 50 can be fitted to the left side wall 30 and the opening 31 can be closed. By loosening the bolts and detaching them from the fitting holes 33, the side cover 50 can be detached from the left side wall 30 and the opening 31 in the left side wall 30 can be opened.

In addition, the cover body 43 of the air box 40 is disposed facing to the left side wall 30, the left side wall 30 is provided with the opening 31, and the side cover 50 is provided to be capable of being fitted to and detached from the opening 31. Therefore, by detaching the side cover 50 from the left side wall 30 to open the opening 31, the cover body 43 can be easily detached from the box main body 42 by utilizing the opening 31.

In order to ensure that the driver can easily sit astride the saddle ride type seat 17 of the personal watercraft 10, the width of the air box 40 must be reduced. However, the side surface of the air box 40 can be made comparatively large in size. Since the cover body 43 is disposed at the side surface of the air box 40, the cover body 43 can be made relatively large in size. The cover body 43 can be easily detached, and a large opening can be opened in the box main body 42 by detaching the cover body 43. Accordingly, maintenance or inspection of the inside of the box main body 42 can be easily carried out.

Figure 4:
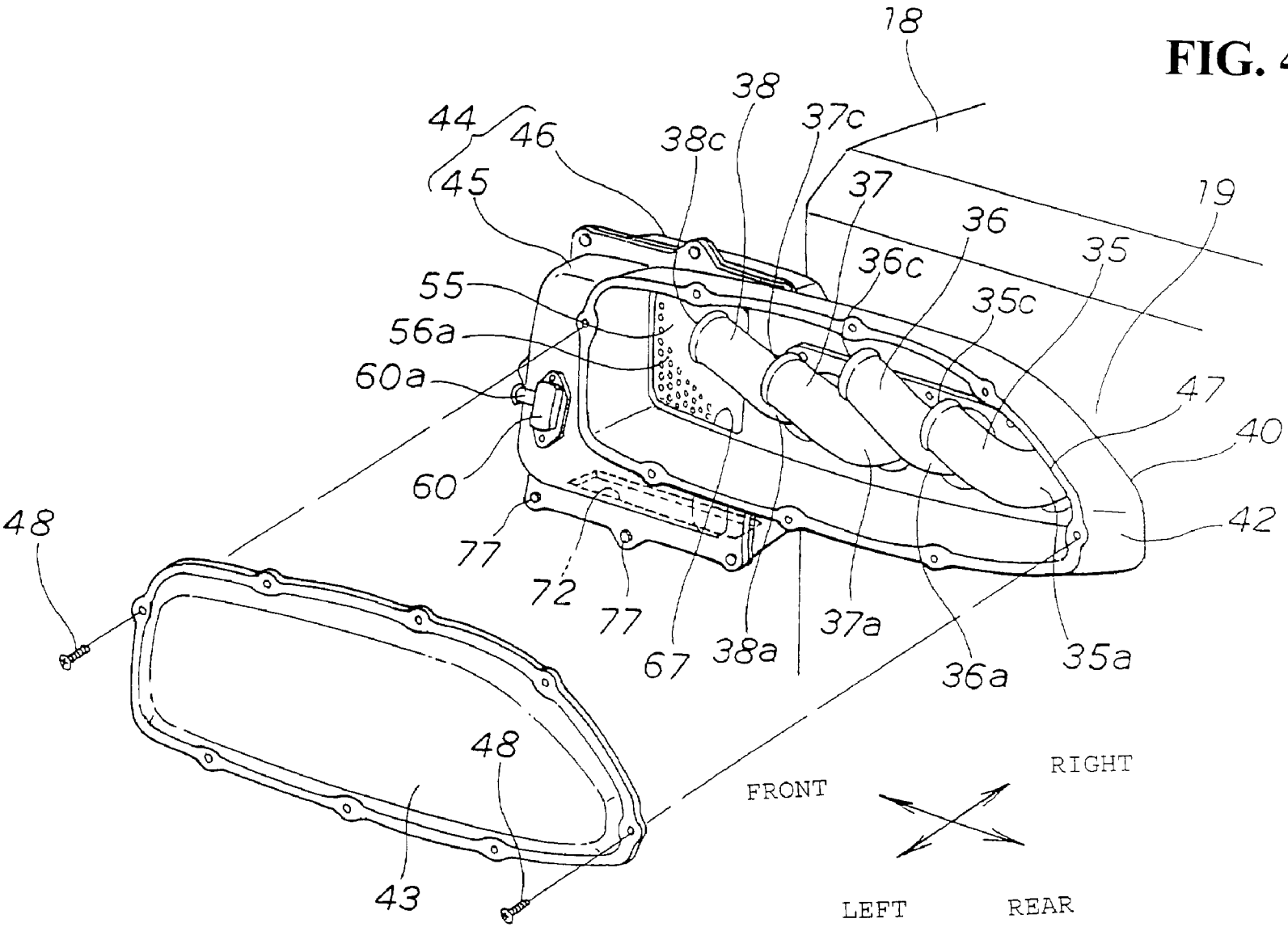
FIG. 4 is a perspective view of a portion of the personal watercraft according to the present invention.

FIG. 4 is a perspective view of a portion of the personal watercraft according to the present invention, and shows a condition where the four cylinders 18*a* provided in the exemplary engine 18 are arranged in the front-rear direction of the watercraft body 11 (shown in FIG. 1). The intake pipes 35 to 38 are communicated respectively to the cylinders 18*a* and are extended from the side surface 19 of the engine 18. The intake pipes 35 to 38 are contained in the box main body 42 of the air box 40, and the cover body 43 is detached from a fitting surface 47 of the box main body 42.

A detailed description will be provided hereinafter with reference to the intake pipes 35 to 38, e.g., the first to fourth intake pipes 35, 36, 37, and 38 in order from the rear side toward the front side. When the cover body 43 is fitted to the box main body 42, the cover body 43 is brought into contact with the fitting surface 47 of the box main body 42. In this condition, bolts 48 are fastened, whereby the cover body 43 can be fitted to the box main body 42.

The first through fourth intake pipes 35, 36, 37, and 38 can be covered with the cover body 43 of the box main body 42 by fitting the cover body 43 to the box main body 42, so that sea water or water can be prevented from splashing onto the first to fourth intake pipes 35, 36, 37, and 38. The first to fourth intake pipes 35 to 38 are bent in the vicinity of base portions 35*a* to 38*a* thereof, whereby the intake pipes 35 to 38 can be extended forward with a rising gradient. The lengths of the first to fourth intake pipes 35 to 38 can be relatively large without excessively projecting the first to fourth intake pipes 35 to 38 to the left side from the center 10*a* (shown in FIG. 1) of the watercraft body 10.

Figure 5:
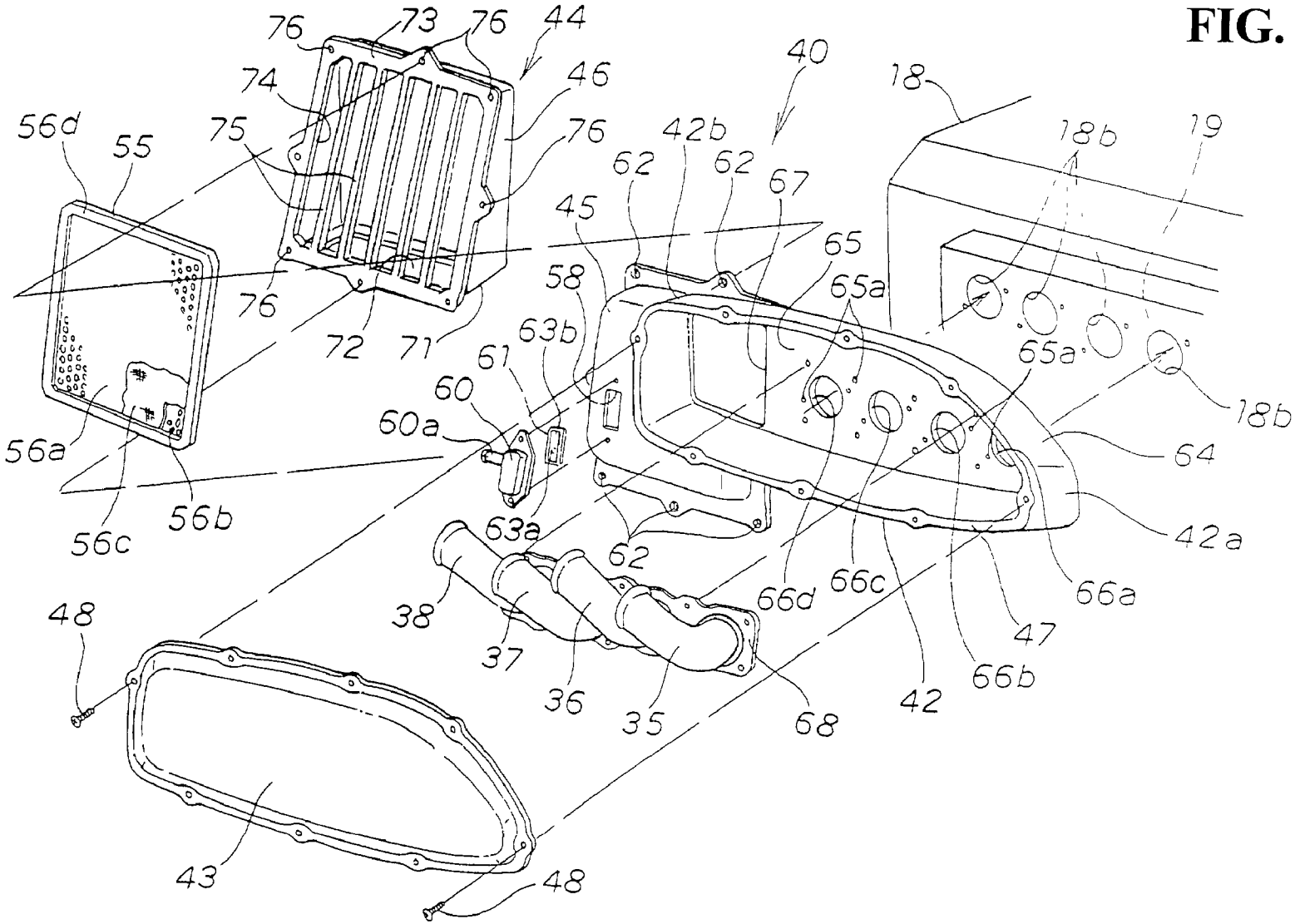
FIG. 5 is an exploded, perspective view of a portion of the personal watercraft according to the present invention.

FIG. 5 is an exploded perspective view of a portion of the personal watercraft according to the present invention. The air box 40 includes the box main body 42 capable of being fitted to the side surface 19 of the engine 18 and containing the first to fourth intake pipes 35 to 38. The cover body 43 is capable of being fitted to and detached from the fitting surface 47 of the box main body 42, and the support frame 45 is formed integrally with a front end portion of the box main body 42. The bulged or expanded cover 46 is capable of being fitted to and detached from the support frame 45, and a breather 60 is fitted to a breather opening 58 of the support frame 45. The support frame 45 and the bulged cover 46 form the bulged portion 44.

The box main body 42 has a structure in which an outer peripheral wall 64 is formed in a roughly rectangular shape, an inside end surface of the outer peripheral wall 64 on the side of the engine 18 is closed with an inner wall 65, and an outside end surface (namely, the fitting surface) 47 of the outer peripheral wall 64 on the side of the left side wall 30 (shown in FIG. 2) is opened. The inner wall 65 is provided with four insertion holes, e.g., first to fourth insertion holes 66*a* to 66*d*, arranged toward the front side from the rear end 42*a* of the box main body 42. A rectangular air intake port 67 is formed on the front side of the fourth insertion hole 66*d*.

The support frame 45 is projected forwards from a front end portion 42*b* of the box main body 42. The breather opening 58 for fitting the breather 60 and a breather trap 61 is provided in the vicinity of the box main body 42. Fitting holes 62 for fitting the bulged or expanded cover 46 are provided along the outer periphery of the support frame 45.

According to the box main body 42, bolts (not shown) are inserted into fitting holes 65*a* of the inner wall 65, and the box main body 42 is fitted to the side surface 19 of the engine 18 by the bolts. The base portions 35*a* to 38*a* of the first to fourth intake pipes 35 to 38 are inserted respectively into the first to fourth insertion holes 66*a* to 66*d* of the inner wall 65. The base ends 35*a* to 38*a* are inserted respectively into the intake ports 18*b* of the engine 18. In this condition, the first to fourth intake pipes 35 to 38 are fitted to the inner wall 65 by a fixing member 68.

Figure 6:
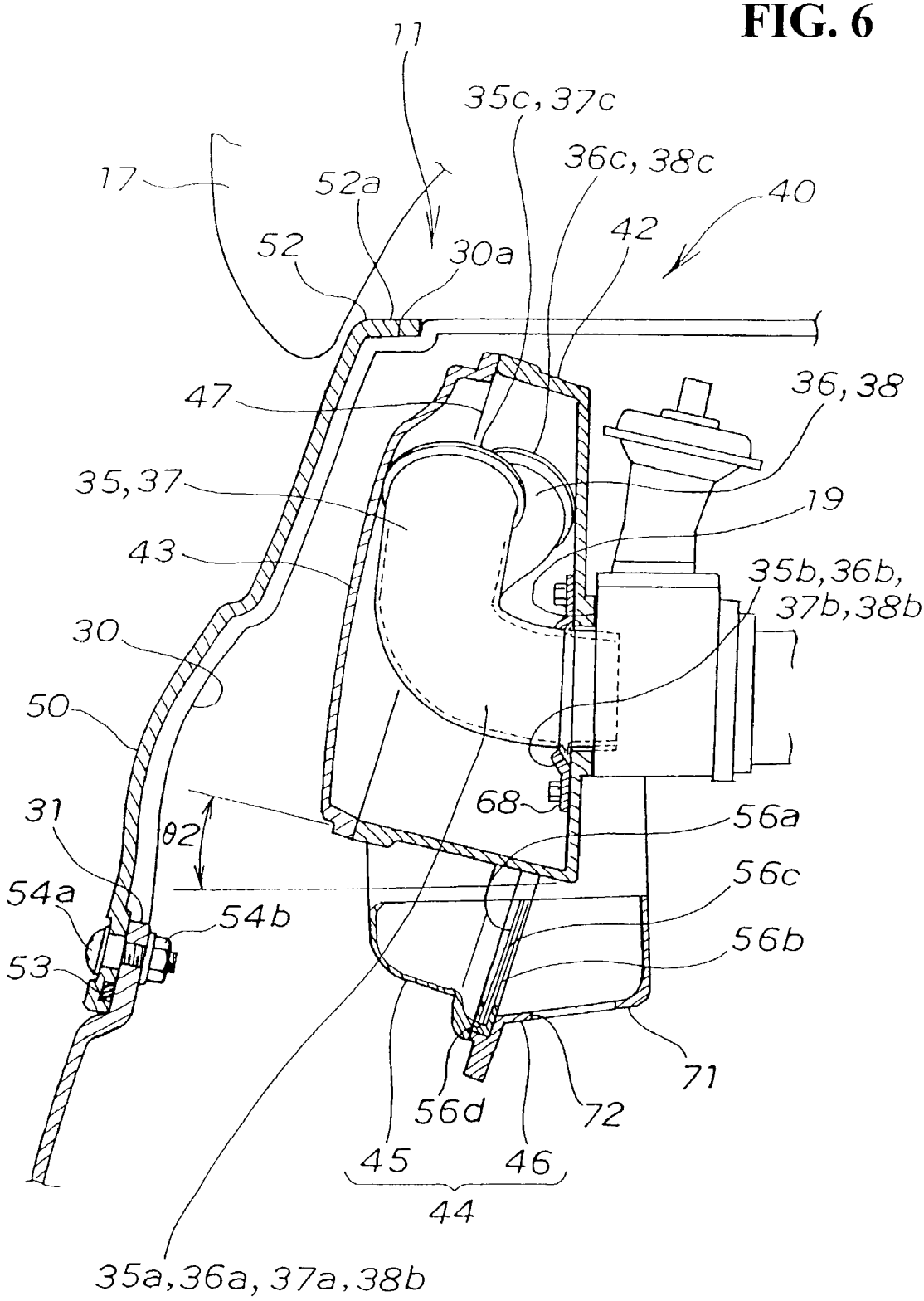
FIG. 6 is a sectional view of a portion of the personal watercraft according to the present invention.

The base ends 35*a* to 38*a* of the first to fourth intake pipes 35 to 38 are provided respectively with flanges 36*b* to 38*b* (shown in FIG. 6). These flanges 35*b* to 38*b* are pressed by the fixing member 68, whereby the first to fourth intake pipes 35 to 38 can be fixed. The first to fourth intake pipes 35 to 38 and the fixing member 68 are provided as separate members, whereby the shapes of the first to fourth intake pipes 35 to 38 can be simplified. Therefore, the first to fourth intake pipes 35 to 38 can be easily produced by blow molding, and the cost of the first to fourth intake pipes 35 to 38 can be reduced.

In contrast, ordinary intake pipes generally are each integrally provided with a fixing member at the base end thereof. Therefore, the intake pipes are complicated in shape, and are difficult to produce by blow molding. Accordingly, it is difficult to reduce the cost of the ordinary intake pipes.

However, the method for molding the first to fourth intake pipes 35 to 38 is not limited to the above-mentioned, and they can be produced by injection molding or other methods. Further, the bulged or expanded cover 46 is fitted to the support frame 45 with the intake trap 55 clamped therebetween (See FIG. 4). The bulged cover 46 has a structure in which a lower portion 71 expands or is bulged to the inside of the watercraft body 11 (shown in FIG. 12), whereby the bulged cover 46 is formed in a roughly triangular shape in side view, the lower portion 71 is provided with a suction port 72, an opening 74 of a fitting surface 73 is provided with a louver 75 for supporting the intake trap 55, and an outer periphery is provided with fitting holes 76 facing to the fitting holes 62 of the support frame 45.

The intake trap 55 is a rectangular member in which a metal mesh net 56*c* (See also FIG. 6) is sandwiched between two sheets of punching metals 56*a* and 56*b* in an example, and the punching metals 56*a*, 56*b*, and the metal mesh net 56*c* are integrally fitted by a frame body 56*d*. With this structure, by inserting bolts 77 (shown in FIG. 4) into the fitting holes 62 of the support frame 45 and the fitting holes 76 of the bulged cover 46 in the condition where the intake trap 55 is clamped between the support frame 45 and the bulged cover 46, the bulged cover 46 can be fitted to the support frame 45 (See also FIG. 6).

In the same manner as the intake trap 55, the breather trap 61 has a structure in which a metal mesh net (not shown) is sandwiched between rectangular punching metals 63*a* (only the one on this side is shown). The punching metals 63*a* and the metal mesh net are integrally fitted by a frame body 63*b*. The breather trap 61 is provided between the breather 60 and the support frame 45 by fitting the breather 60 to the support frame 45 of the bulged portion 44. Since the breather 60 is provided at the support frame 45 of the bulged portion 44 with the breather trap 61 therebetween, a breather pipe extending from the engine can be opened into the bulged portion 44 through a pipe 60*a* of the breather 60.

As seen in FIG. 4, air is drawn into the bulged portion 44 through the suction port 72 provided in the lower portion 71 of the bulged cover 46, and the air taken drawn into the bulged portion 44 is introduced into the box main body 42 through the intake trap 55 and the air intake port 67. The air introduced into the box main body 42 is introduced into the first to fourth intake pipes 35 to 38 through respective inlets 35*c* to 38*c* of the first to fourth intake pipes 35 to 38, and is introduced into the respective cylinders 18*a* (shown in FIG. 1) through the first to fourth intake pipes 35 to 38.

Since the intake trap 55 is provided in the bulged portion 44, dust and the like contained in air can be removed by the intake trap 55. On the other hand, even if sparks should flow into the side of the bulged cover 46, the sparks can be trapped by the intake trap 55 or the breather trap 61 (shown in FIG. 5). As seen in FIG. 2, the bulged cover 46 is expanded or bulges to the inside of the watercraft body 11, and the lower portion 71 thereof is provided with the suction port 72, and the suction port 72 can be disposed on the inside of the watercraft body 11. As a result, the suction port 72 can be directed toward the side of the engine 18, and the suction port 72 can be prevented from projecting to the outside.

If the personal watercraft 10 should be turned upside down, and at the time of righting the personal watercraft 10 from the inverted condition into the normal condition, the resistance acting against the movement of the suction pipe 72 in the sea water can be reduced. Therefore, the personal watercraft 10 can be easily righted from an inverted condition into a normal operating condition.

FIG. 6 is a sectional view of a portion of the personal watercraft according to the present invention. FIG. 6 shows a condition where the first to fourth intake pipes 35 to 38 are bent at their base ends 35*a* to 38*a* and extended upward with a rising gradient along the left side wall 30 on the lower side of the seat 17. The cover body 43 is disposed facing to the left side wall 30, the left side wall 30 facing to the cover body 43 is provided with the opening 31. The side cover 50 is detachably fitted to the opening 31, the fitting surface 47 of the box main body 42 for fitting the cover body 43 is formed to be substantially parallel to the left side wall 30, and the support frame 45 is integrally formed at a location on the front side of the box main body 42, e.g., the fourth intake pipe 38. The bulged cover 46 fitted to the support frame 45 is expanded to the inside in the width direction of the watercraft body 11, and the air suction port 72 is opened in the lower portion 71 of the bulged cover 46.

With the first to fourth intake pipes 35 to 38 bent at their base ends 35*a* to 38*a* and extended upward with a rising gradient along the left side wall 30 on the lower side of the seat 17, the inlet 35*c* to 38*c* of the first to fourth intake pipes 35 to 38 can be located at positions higher than the base ends 35*a* to 38*a*. Even if sea water or water should penetrate into the watercraft body 11, it is difficult for the sea water or water to reach the inlets 35*c* to 38*c* of the first to fourth intake pipes 35 to 38. Therefore, it is possible to prevent the sea water or water from penetrating into the first to fourth intake pipes 35 to 38 through the inlets 35*c* to 38*c* of the first to fourth intake pipes 35 to 38.

As shown in FIG. 3, the side cover 50 is a member having a seal member 53 fitted to the peripheral edge excluding the upper end 52. The seal member 53 is laid on the left side wall 30. The font end of a bent portion 52*a* of the upper end 52 is mounted on a stepped portion 30*a* of the left side wall 30. The side cover 50 is fixed to the left side wall 30 by bolts and nuts 54*a* and 54*b*. By detaching the side cover 50 from the left side wall 30 to open the opening 31, the cover body 43 can be easily detached from the box main body 42 by utilizing the opening 31. With the base ends 35*a* to 38*a* of the first to fourth intake pipes 35 to 38 provided respectively with the flanges 35*b* to 38*b* (See also FIG. 7), the first to fourth intake pipes 35 to 38 can be fixed by pressing these flanges 35*b* to 38*b* with the fixing member 68.

Figure 7:
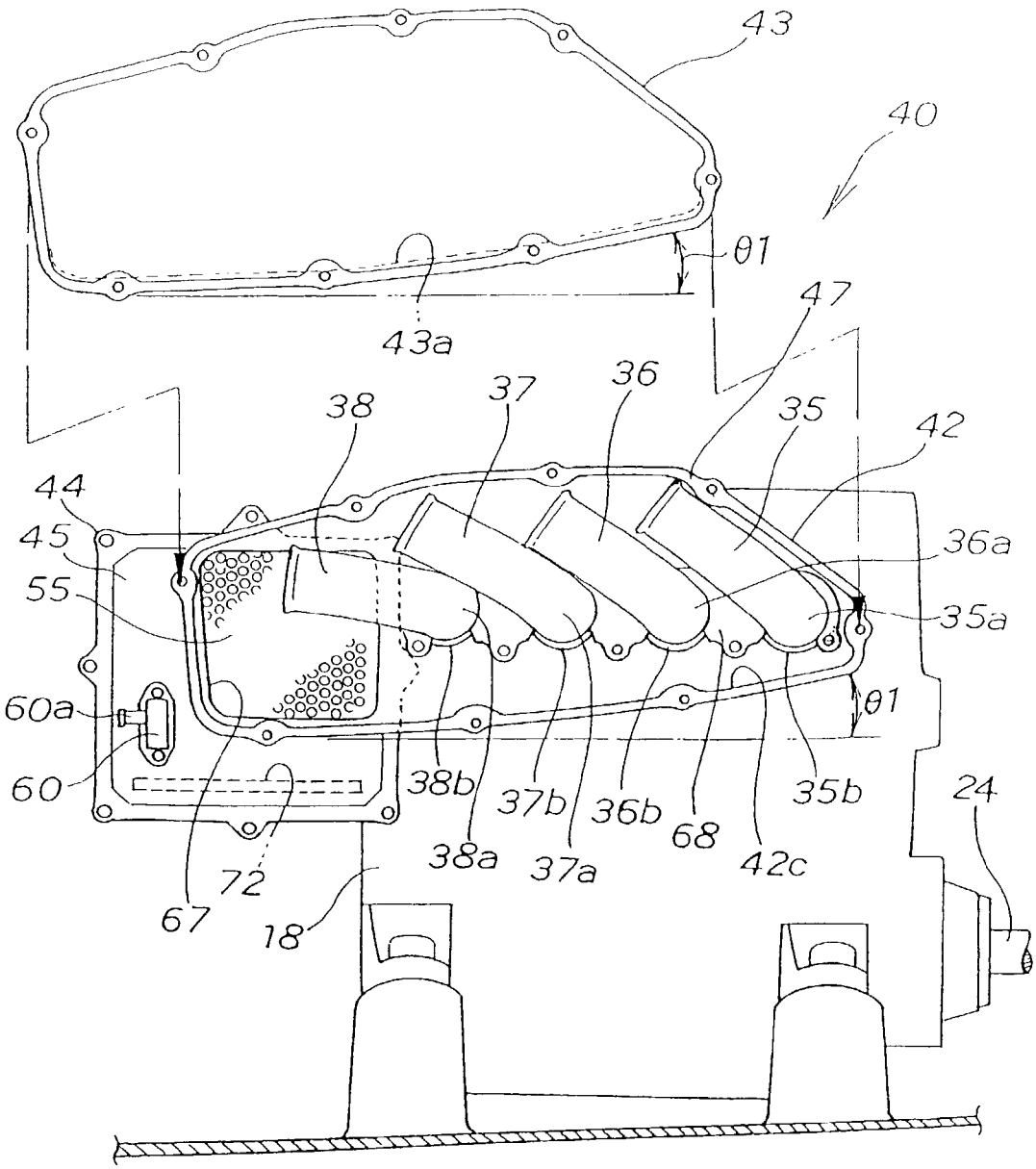
FIG. 7 is a side view of a portion of the personal watercraft according to the present invention.

FIG. 7 is a side view of a portion of the personal watercraft according to the present invention, and shows a condition where the cover body 43 has been detached from the box main body 42. The air box 40 has a structure in which a lower surface 42*c* of the box main body 42 and a lower surface 43*a* of the cover body 43 have a descending gradient of an inclination angle θ1 toward the air intake port 67.

With the lower surface 42*c* of the box main body 42 and the lower surface 43*a* of the cover body 43 having the descending gradient of the inclination angle θ1 toward the air intake port 67, even if sea water or water should penetrate into the air box 40, the sea water or water having penetrated into the air box 40 can be efficiently led along the lower surface 42*c* of the box main body 42 and the lower surface 43*a* of the cover body 43 to the air intake port 67. Entrained water will then flow out through the air intake port 67 into the bulged portion 44.

Since the lower portion 71 of the bulged portion 44 is provided with the suction port 72, the sea water or water having flowed into the bulged portion 44 can be securely discharged through the suction port 72 to the outside of the bulged portion 44. Therefore, the sea water or water can be prevented from accumulating in the air box 40 or in the bulged portion 44. In addition, the lower surfaces 42*c* and 43*a* of the box main body 42 and the cover body 43 have a descending gradient of an inclination angle θ2 toward the inside of the watercraft body, namely, toward the air intake port 67, as shown in FIG. 6. Therefore, the sea water or water in the air box 40 can be efficiently led to the air intake port 67, and the sea water or water having flowed into the bulged portion 44 can be securely discharged through the suction port 72 to the outside of the bulged portion 44.

The first to fourth intake pipes 35 to 38 are bent at their base ends 35*a* to 38*a* along the left side wall 30 on the lower side of the seat 17, as has been described in reference to FIG. 6. The first to fourth intake pipes 35 to 38 can be extended upwards without projecting the left side wall 30 (shown in FIG. 6) on the lower side of the seat 17 toward the outside. The spacing S (shown in FIG. 2) between the left and right side walls 30 and 32 on the lower side of the seat 17 can be reduced, and the driver can sit astride the saddle ride type seat 17 in a natural posture.

Figure 8:
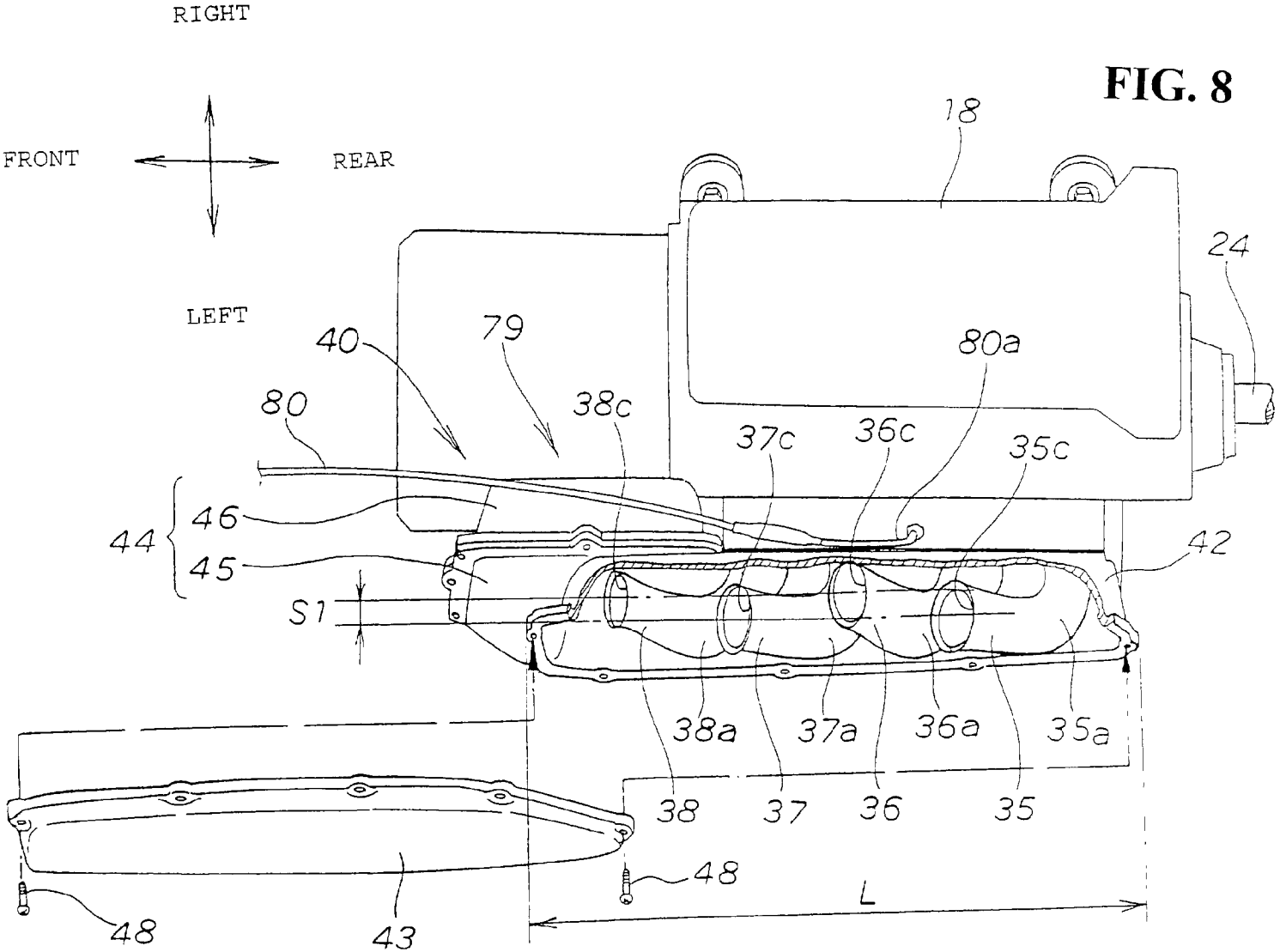
FIG. 8 is a plan view of a portion of the personal watercraft according to the present invention.

FIG. 8 is a plan view of a portion of the personal watercraft according to the present invention, and shows a condition where the cover body 43 has been detached from the box main body 42. The first to fourth intake pipes 35 to 38 are bent so that their respective inlets 35*c* to 38*c* are arranged in a zigzag manner. Namely, the first and third intake pipes 35 and 37 have similarly shaped tubes with their base ends 35*a* and 37*a* bent gradually. The second and fourth intake pipes 36 and 38 have similarly shaped tubes with their base ends 36*a* and 38*a* bent comparatively sharply.

With the first and third intake pipes 35 and 37 bent gradually and with the second and fourth intake pipes 36 and 38 bent comparatively sharper, the respective inlets 35*c* and 37*c* of the first and third intake pipes 35 and 37 can be located at positions spaced from the center 10*a* (See FIG. 2) of the personal watercraft 10. The inlets 36*c* and 38*c* of the second and fourth intake pipes 36 and 38 can be located at positions near the center 10*a* of the personal watercraft 10, e.g., on the inner side of the watercraft body 11 by a distance S1 from the inlets 35*c* and 37*c*.

The respective inlets 35*c* to 38*c* of the first to fourth intake pipes 35 to 38 can be arranged in the zigzag manner, so that the inlets 35*c* to 38*c* can be densely arranged. Therefore, the box main body 42 for containing the first to fourth intake pipes 35 to 38 can be made compact, e.g., its length L can be reduced. Accordingly, even if the first to fourth intake pipes 35 to 38 are made longer and extended upwards, the air box 40 can be arranged close to the center of the watercraft body 11.

Therefore, the spacing S (shown in FIG. 2) between the left and right side walls 30 and 32 on the lower side of the seat 17 can be reduced, so that the driver can sit astride the seat 17 in a natural posture. Where the respective inlets 35*c* to 38*c* of the first to fourth intake pipes 35 to 38 are arranged linearly, the length L of the box main body is large. For example, when it is intended to set the box main body close to the center of the watercraft body, a comparatively large space must be secured on the central side of the watercraft body. However, it is difficult to secure a comparatively large space on the central side of the watercraft body, so that the box main body would be located on the outside of the watercraft body.

Therefore, the spacing between the left and right side walls on the lower side of the seat 17 cannot be reduced, and the driver cannot sit astride the seat 17 in a natural posture. In addition, the air box 40 is provided with the bulged cover 46 expanded to the inside in the width direction of the watercraft body 11 (shown in FIG. 2) at a location on the front side of the fourth intake pipe 38. Therefore, the bulged cover 46 can be disposed in a space 79 on the front side of the engine 18, so that even if the bulged cover 46 expands to the inside in the width direction of the watercraft body 11, e.g., to the side of the engine 18, the bulged cover 46 will not interfere with the engine 18. Therefore, the bulged cover 46 can be arranged close to the side of the center 10*a* (shown in FIG. 2) of the personal watercraft 10, so that the spacing S between the left and right side walls 30 and 32 extending downwards from the lower side of the seat 17 can be reduced. Accordingly, the driver can sit astride the seat 17 in a natural posture.

Figure 9:
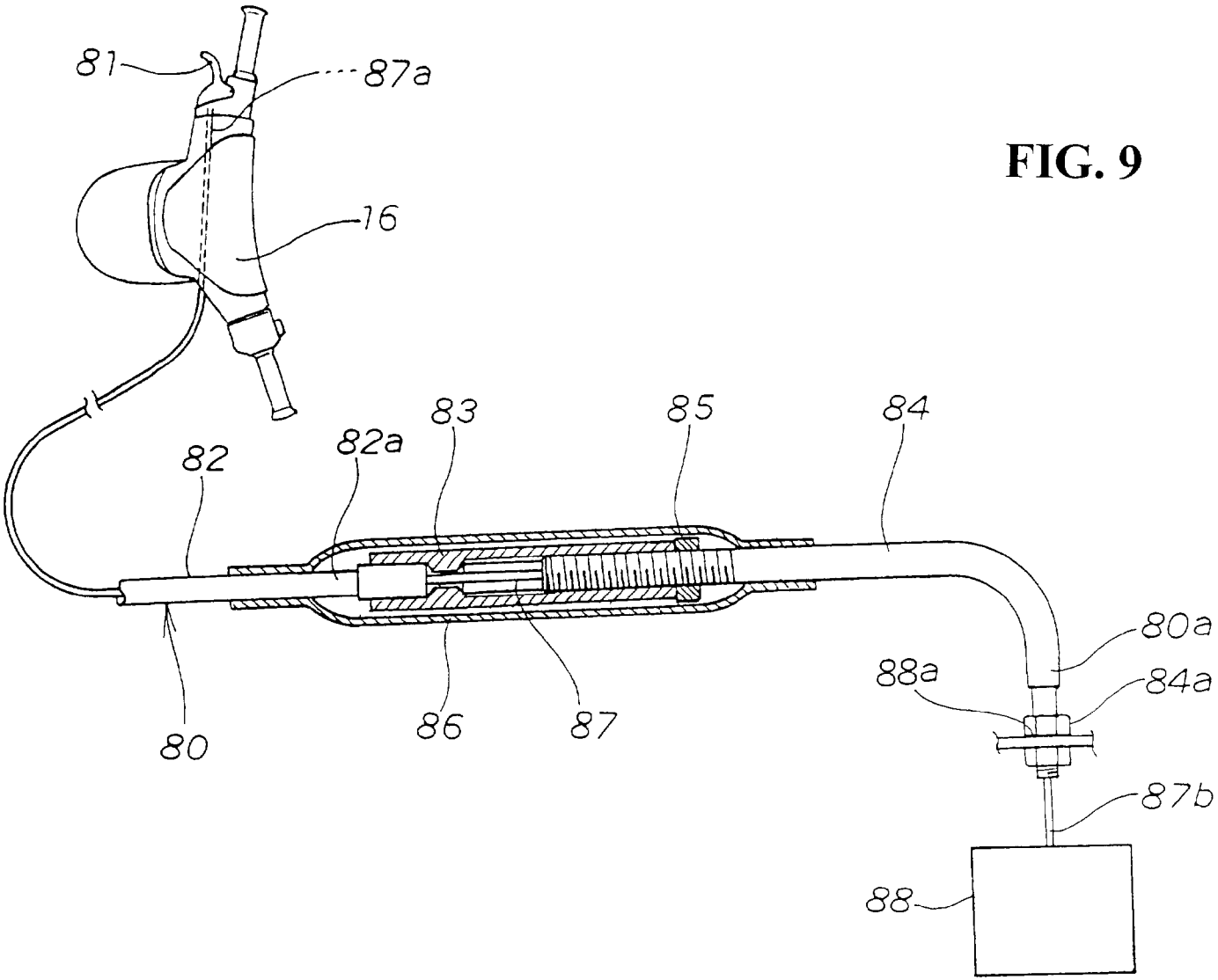
FIG. 9 is a sectional view of a throttle cable of the personal watercraft according to the present invention.

A throttle valve 88 (shown in FIG. 9) is provided in the vicinity of an inner wall of the air box 40. The tip end 80*a* of a throttle cable 80 is connected to the throttle valve 88. The base end of the throttle cable 80 is connected to a throttle lever 81 (shown in FIG. 9) at the steering handle 16. FIG. 9 is a sectional view of the throttle cable of the personal watercraft according to the present invention. The throttle cable 80 has a structure in which a connection portion 84 is connected to the tip end 82*a* of an outer case 82 through an adjusting nut 83. The adjusting nut 83 is locked by a lock nut 85, and the lock nut 85 and the adjusting nut 83 are covered with a boot 86. An inner cable 87 is slidably fitted to the outer case 82, the adjusting nut 83 and the connection portion 84. The base end 87*a* of the inner cable 87 is connected to the throttle lever 81 at the steering handle 16, and the tip end 87*b* of the inner cable 87 is connected to a lever (not shown) of the throttle valve 88.

By loosening the lock nut 85 and rotating the adjusting nut 83, the connection position 84*a* of the connection portion 84 can be adjusted to the fitting position 88*a* of the throttle valve 88. With the adjusting nut 83 disposed on the upper side of the engine 18 as shown in FIG. 8, the adjusting nut 83 can be easily operated from the upper side of the engine 18. With the throttle lever 81 connected to the lever of the throttle valve 88 through the throttle cable 80, it is possible to operate the inner cable 87 by the throttle lever 81 so as to control the lever of the throttle valve 88, thereby regulating the amount of an air-fuel mixture gas supplied to each of the cylinders.

Figure 10:
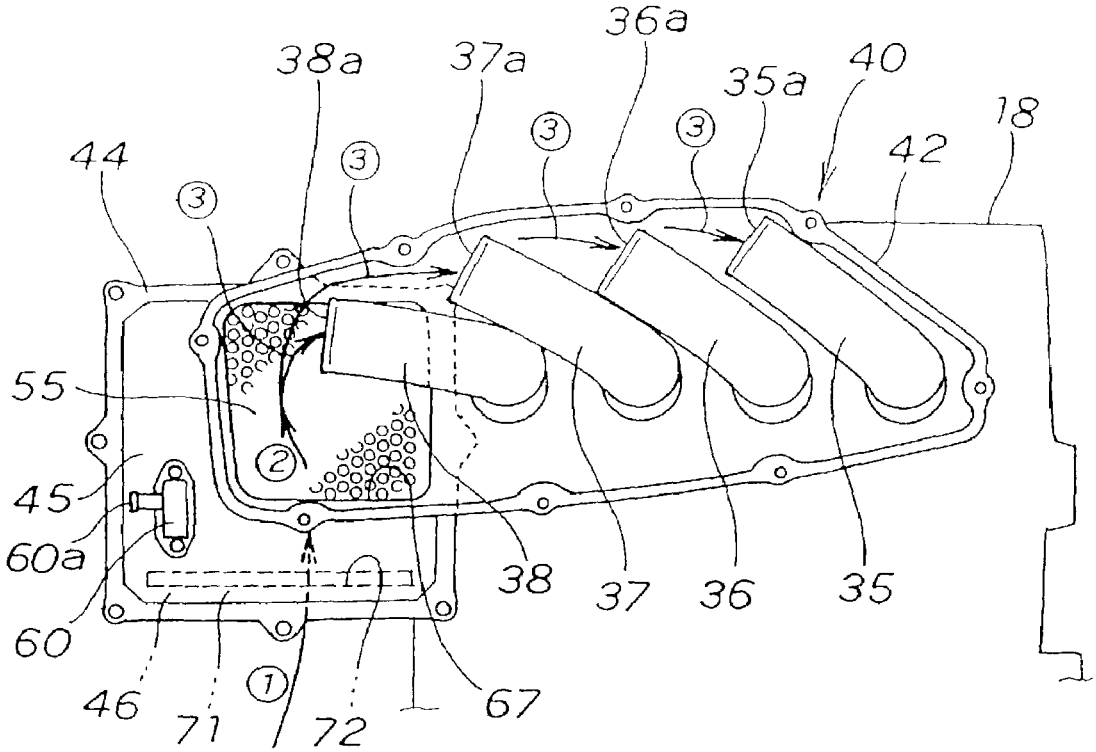
FIG. 10 is a view of an action of the personal watercraft according to the present invention.

Actions of the personal watercraft will be described hereinafter with reference to FIGS. 10 to 12. FIG. 10 is a view of a first action of the personal watercraft according to the present invention, and shows a condition where air is drawn into the watercraft. Air is drawn into the bulged portion 44 as indicated by arrow 1 through the suction port 72 formed in the lower portion 71 of the bulged cover 46. The air drawn into the bulged portion 44 is led to the air intake port 67 though the intake trap 55, and the air led to the air intake port 67 is introduced into the box main body 42 as indicated by arrow 2 through the air intake port 67.

Since the air led into the bulged portion 44 passes through the intake trap 55, dust and the like contained in air can be removed by the intake trap 55. Therefore, air can be introduced into the box main body 42 in a filtered and clean condition. The air introduced into the box main body 42 is introduced into the first to fourth intake pipes 35 to 38 as indicated by arrow 3 through the respective inlets 35*c* to 38*c* of the first to fourth intake pipes 35 to 38, and is introduced into the cylinders 18*a* (shown in FIG. 1) through the first to fourth intake pipes 35 to 38. Since the support frame 45 of the bulged portion 44 is provided with the breather 60 with the breather trap 61 (shown in FIG. 5) therebetween, the breather pipe extending from the engine can be opened into the bulged portion 44 through the pipe 60*a* of the breather 60.

Figure 11:
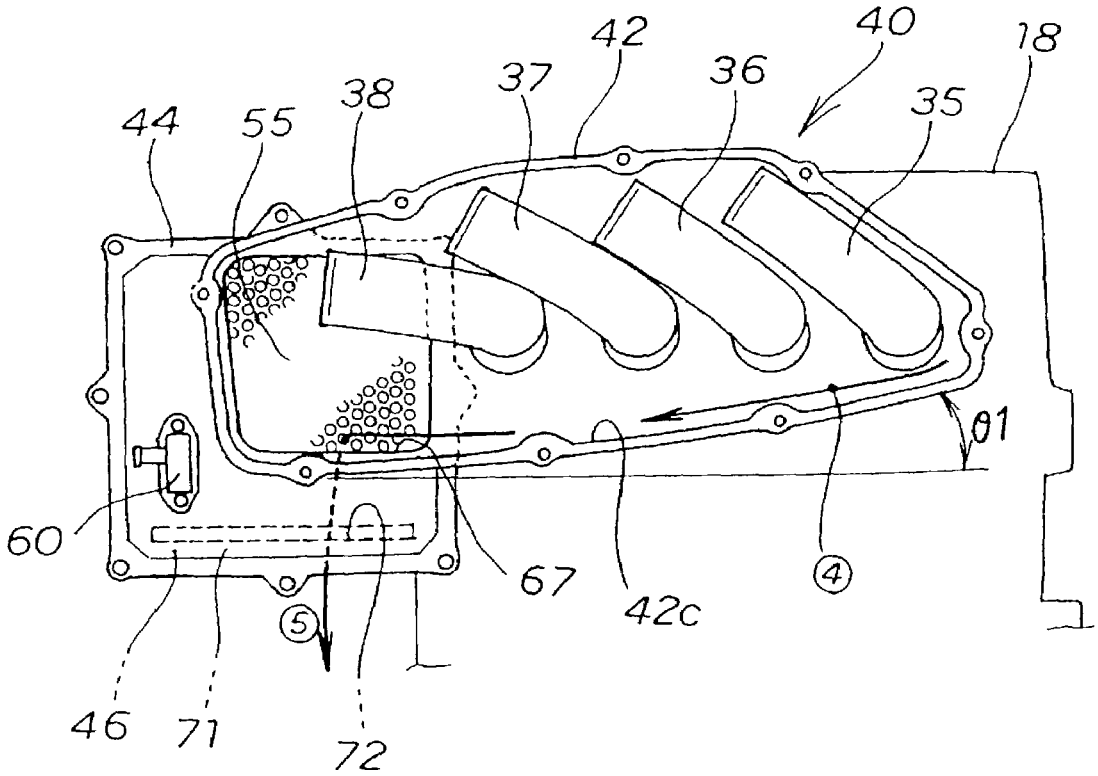
FIG. 11 is a view of a second action of the personal watercraft according to the present invention.

FIG. 11 is a view of a second action of the personal watercraft according to the present invention, and shows a condition where sea water or water that has penetrated the air box 40 is removed. During operation of the personal watercraft 10 shown in FIG. 1, the personal watercraft 10 might be turned upside down. If the personal watercraft 10 should be turned upside down, sea water or water may penetrate into the air box 40. If the personal watercraft 10 is returned into the normal position under this condition, the sea water or water accumulates on the lower surface 42*c* of the box main body 42 and the lower surface 43*a* (shown in FIG. 7) of the cover body 43.

Since the lower surface 42*c* of the box main body 42 and the lower surface 43*a* of the cover body 43 having a descending gradient of the inclination angle θ1 towards the air intake port 67, the sea water or water in the air box 40 can be efficiently led along the lower surfaces 42*c* and 43*a* to the air intake port 67 as indicated by arrow 4. The water then securely flows out through the air intake port 67 into the bulged portion 44 as indicated by arrow 5. The sea water or water having flowed out into the bulged portion 44 can be securely discharged through the suction port 72. Therefore, it is possible to prevent sea water or water from accumulating in the air box 40 or in the bulged portion 44.

In addition, with the lower surface 42*c* of the box main body 42 and the lower surface 43*a* of the cover body 43 having a descending gradient of the inclination angle θ2 toward the inside of the watercraft body 11 as shown in FIG. 6, the sea water or water in the air box 40 can be efficiently led to the air intake port 67, and the sea water or water having flown out through the air intake port 67 into the bulged portion 44 can be further securely discharged through the suction port 72.

Figure 12:
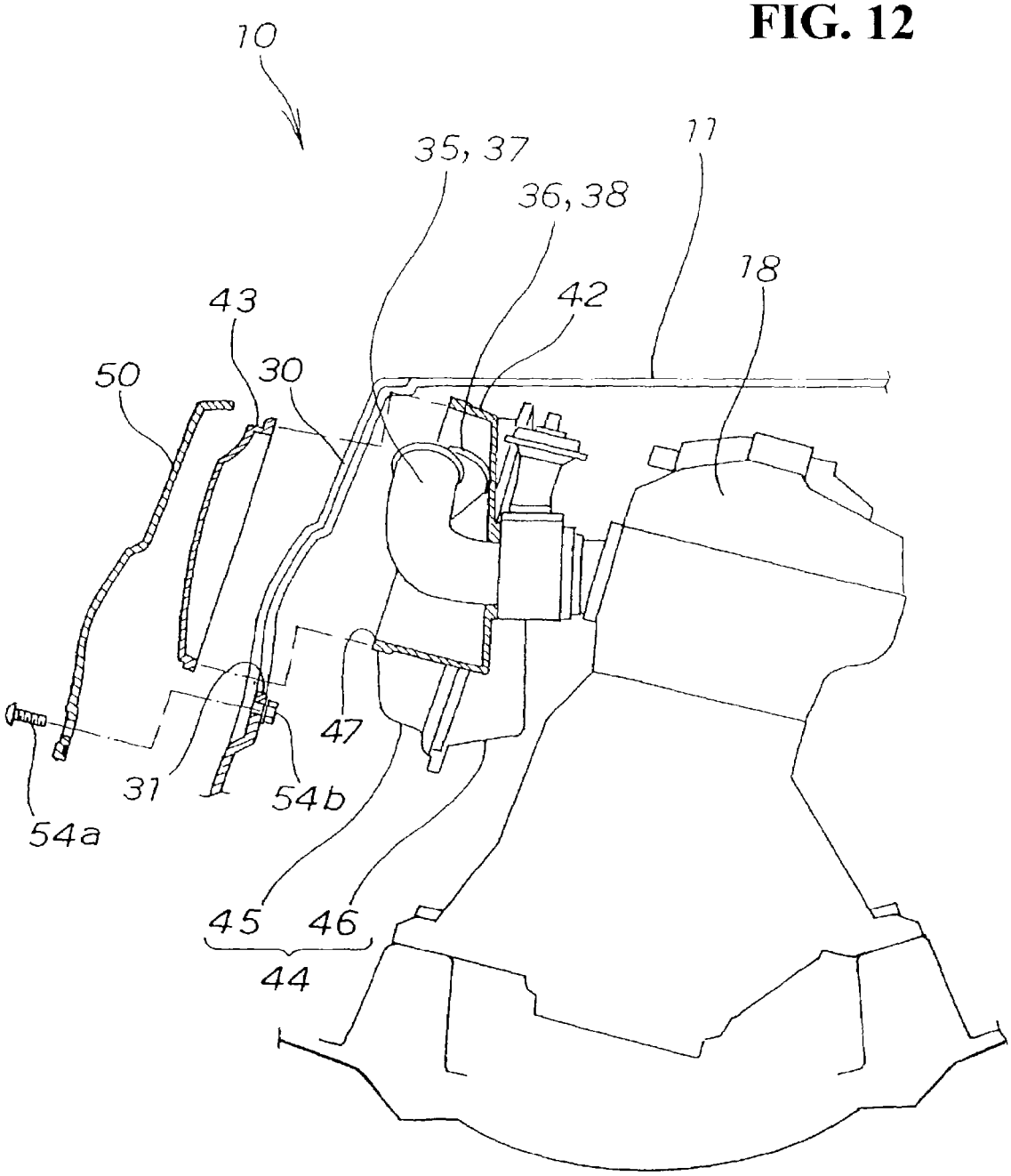
FIG. 12 is a view of a third action of the personal watercraft according to the present invention.
Figure 13:
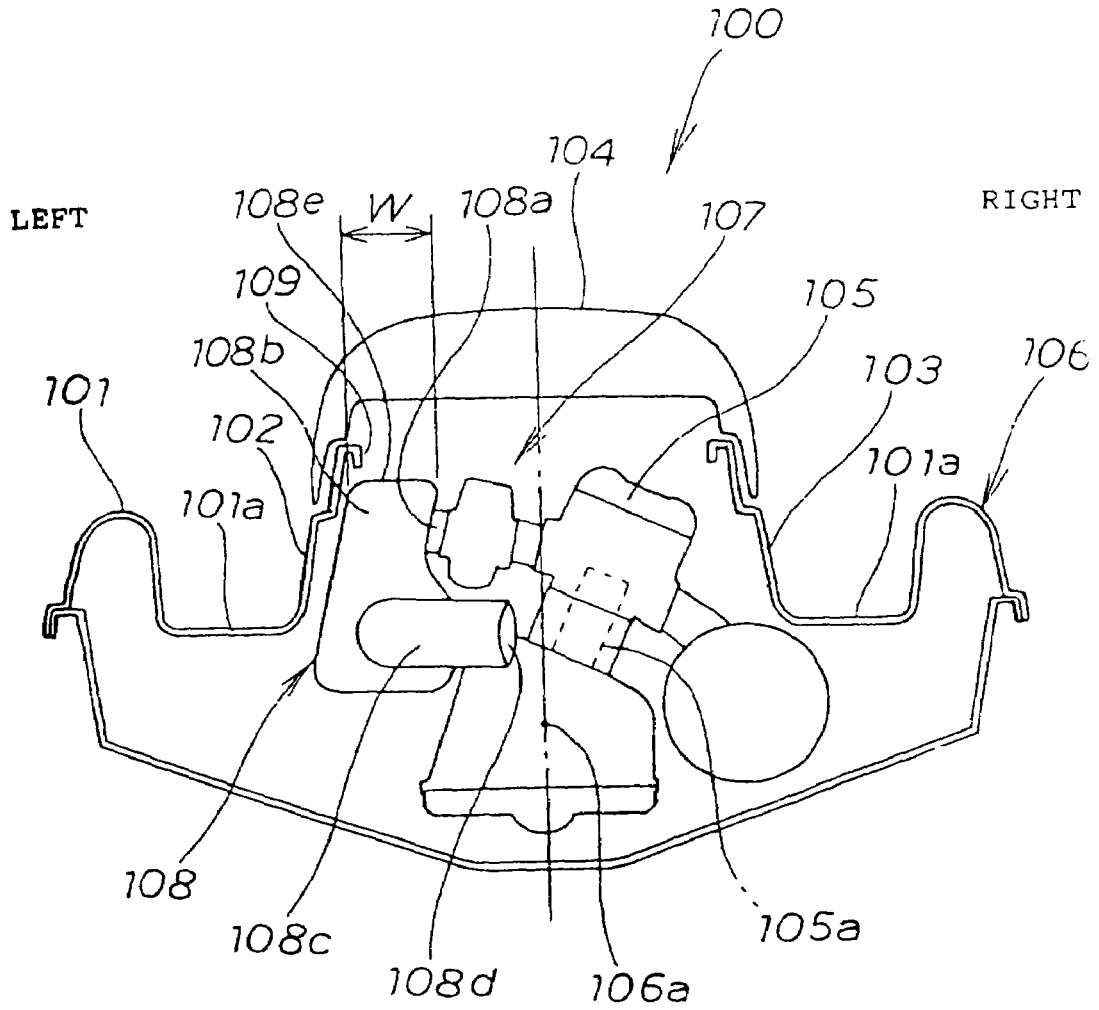
FIG. 13 BACKGROUND ART
FIG. 13 is a sectional view of a conventional personal watercraft.

FIG. 12 is a view of a third action of the personal watercraft according to the present invention, and shows a condition where maintenance or inspection of the first to fourth intake pipes 35 to 38 in the air box 40 is carried out. The left side wall 30 faces to the cover body 43 provided with the opening 31 and the side cover 50 is detachably fitted to the opening 31. When maintenance or inspection is performed of components, e.g., the first to fourth intake pipes 35 to 38, the side cover 50 is detached from the left side wall 30 to open the opening 31, and the cover body 43 is easily detached from the box main body 42 by utilizing the opening 31.

Since the cover body 43 is disposed at the side surface of the air box 40, the cover body 43 can be relatively large in shape. Since the cover body 43 can be easily detached and the large opening can be opened in the box main body 42 by detaching the cover body 43, it is possible to easily carry out the maintenance or inspection of the first to fourth intake pipes 35 to 38 in the air box 40.

When the cover body 43 is detached, the fitting surface 47 of the box main body 42 fronts on the opening 31 of the left side wall 30, so that the maintenance or inspection of the first to fourth intake pipes 35 to 38 in the air box 40 can be carried out easily. While an example in which four intake pipes are provided as has been described in the above embodiment, the present invention can be applied to an engine(s) having any number of intake pipes.

In addition, while the bulged portion 44 of the air box 40 has been provided at the front end portion 42*b* of the box main body 42 in the above embodiment, the bulged portion 44 may be provided at a rear end portion 42*a* of the box main body 42. Further, while a jet propulsion watercraft propelled by a jet propeller as an example of the personal watercraft 10 has been described in the above embodiment, the propulsion of the personal watercraft is not limited to this type of system.

A fastening tool can be easily inserted to head portions of the bolts from the outside of the opening, so that the cover body can be easily detached without special labor. Accordingly, maintenance or inspection of intake system equipment can be easily carried out. In addition, since the fitting surface of the box main body front on the opening in the side wall after the cover body is detached, the maintenance or inspection of the inside of the air box can be carried out further easily.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A personal watercraft comprising:

a watercraft body having a central portion, a forward portion and a rearward portion;

a saddle-ridden seat being generally provided at the central portion of the watercraft body;

side walls of the watercraft body extending downwards from left and right lower edges of said seat, wherein said side walls each include a respective opening;

a removable side cover covering an opening in at least one of the side walls and forming a portion of said at least one of the side walls extending downwards from left and right lower edges of said seat, an engine mounted on the lower side of said seat with the axis of a crankshaft thereof directed in a front-rear direction of said watercraft body with respect to said forward portion and said rearward portion;

a plurality of cylinders being provided in said engine and arranged in the front-rear direction of said watercraft body;

intake passages comprising intake pipes being communicated respectively with said cylinders and extending from a side surface of said engine; and an air box containing said intake pipes being provided in a space between said engine and said side walls, wherein said air box includes a box main body having an opening facing toward said at least one of the side walls, the box main body including an outer peripheral wall being formed in a roughly rectangular shape, an inside end surface of the outer peripheral wall on a side of the engine being closed with an inner wall, and an outside end surface of the outer peripheral wall, the inner wall being provided with a plurality of insertion holes; and a cover body capable of being detachably fitted to said opening in the box main body, and facing toward said removable side cover on said at least one of the side walls, so that when the removable side cover and the cover body are both removed, all of the intake pipes are visible when viewed from a lateral direction of the watercraft.

2. The personal watercraft according to claim 1, further comprising a fitting surface for said box main body, wherein the fitting surface of said box main body for fitting said cover body is formed substantially parallel to said side walls.

3. The personal watercraft according to claim 2, wherein said air box includes an expanded portion being provided at a front portion of the box main body.

4. The personal watercraft according to claim 3, wherein the expanded portion includes a support frame being formed integrally with the front portion of the box main body, and an expanded cover detachably fitted to the support frame.

5. The personal watercraft according to claim 4, wherein the cover body of the air box faces toward a left side wall of the watercraft body.

6. The personal watercraft according to claim 1, wherein said air box includes an expanded portion being provided at a front portion of the box main body.

7. The personal watercraft according to claim 6, wherein the expanded portion includes a support frame being formed integrally with the front portion of the box main body, and an expanded cover detachably fitted to the support frame.

8. The personal watercraft according to claim 1, wherein the cover body of the air box faces toward a left side wall of the watercraft body.

9. The personal watercraft according to claim 1, wherein the base ends of the intake pipes are provided respectively with flanges.

10. A method of preventing water from remaining within the personal watercraft according to claim 1, said method comprising covering the intake pipes with the cover body of the box main body by fitting the cover body to the box main body, wherein sea water or water is prevented from splashing onto the intake pipes.

11. A personal watercraft comprising:

a watercraft body having a central portion, a forward portion and a rearward portion;

a saddle-ridden seat being generally provided at the central portion of the watercraft body;

a pair of covers forming side walls extending downwards from left and right lower edges of said seat, an engine mounted on the lower side of said seat with the axis of a crankshaft thereof directed in a front-rear direction of said watercraft body with respect to said forward portion and said rearward portion;

a plurality of cylinders being provided in said engine and arranged in the front-rear direction of said watercraft body;

intake passages comprising intake pipes being communicated respectively with said cylinders and extending from a side surface of said engine;

an air box containing said intake pipes being provided in a space between said engine and said side walls, wherein said air box includes a box main body, wherein said air box includes an outer peripheral wall being formed in a roughly rectangular shape, an inside end surface of the outer peripheral wall on a side of the engine being closed with an inner wall, an outside end surface of the outer peripheral wall, wherein the inner wall is provided with a plurality of insertion holes, and an expanded portion being provided at a front portion of the box main body, said expanded portion including a support frame being formed integrally with the front portion of the box main body, and an expanded cover detachably fitted to the support frame, a cover body, the cover body being disposed in a position facing toward said side walls, wherein the cover body faces toward a left side wall of the watercraft body, an opening provided with said cover body, said side walls facing said cover body, a cover capable of being detachably fitted to said opening;

a fitting surface for said box main body, wherein the fitting surface of said box main body for fitting said cover body is formed substantially parallel to said side walls; and a rectangular air intake port being formed on a front side of at least one of the insertion holes.

12. The personal watercraft according to claim 11, further comprising:

a breather;

a breather trap; and a breather opening for fitting the breather and the breather trap being provided in the vicinity of the box main body.

13. A personal watercraft comprising:

a watercraft body having a central portion, a forward portion and a rearward portion;

a saddle-ridden seat being generally provided at the central portion of the watercraft body;

a pair of covers forming side walls extending downwards from left and right lower edges of said seat, an engine mounted on the lower side of said seat with the axis of a crankshaft thereof directed in a front-rear direction of said watercraft body with respect to said forward portion and said rearward portion;

a plurality of cylinders being provided in said engine and arranged in the front-rear direction of said watercraft body;

intake passages comprising intake pipes being communicated respectively with said cylinders and extending from a side surface of said engine;

an air box containing said intake pipes being provided in a space between said engine and said side walls, wherein said air box includes a box main body, wherein the box main body includes an outer peripheral wall being formed in a roughly rectangular shape, an inside end surface of the outer peripheral wall on a side of the engine being closed with an inner wall, and an outside end surface of the outer peripheral wall, wherein the inner wall is provided with a plurality of insertion holes, a cover body, the cover body being disposed in a position facing toward said side walls, an opening provided with said cover body, said side walls facing said cover body, and a cover capable of being detachably fitted to said opening; and a rectangular air intake port being formed on a front side of at least one of the insertion holes.

14. The personal watercraft according to claim 13, further comprising:

a breather;

a breather trap; and a breather opening for fitting the breather and the breather trap being provided in the vicinity of the box main body.

15. A method of preventing water from remaining within the personal watercraft according to claim 13, said method comprising covering the intake pipes with the cover body of the box main body by fitting the cover body to the box main body, wherein sea water or water is prevented from splashing onto the intake pipes.

* * * * *